US005954126A

United States Patent [19]

Armbruster

[11] Patent Number: 5,954,126

[45] Date of Patent: Sep. 21, 1999

[54] DISK COOLER

[75] Inventor: Horst Armbruster, Illingen, Germany

[73] Assignee: Behr GmbH & Co., Stuttgart, Germany

[21] Appl. No.: 09/030,948

[22] Filed: Feb. 26, 1998

[30] Foreign Application Priority Data

Feb. 26, 1997 [DE] Germany ..... 197 07 647

[51] Int. Cl.[6] ..... F28F 3/08

[52] U.S. Cl. ..... 165/167; 165/103; 165/166; 165/283; 165/DIG. 916

[58] Field of Search ..... 165/103, 167, 165/157, 283, 916, 166

[56] References Cited

U.S. PATENT DOCUMENTS

| | | | |
|---|---|---|---|
| 4,708,199 | 11/1987 | Yogo et al. . | |
| 4,967,835 | 11/1990 | Lefeber | 165/167 |
| 5,154,225 | 10/1992 | Armbruster et al. | 165/167 |
| 5,179,999 | 1/1993 | Meekins et al. | 165/167 |
| 5,182,856 | 2/1993 | Armbruster | 165/167 |
| 5,236,043 | 8/1993 | Armbruster et al. | 165/167 |
| 5,765,632 | 6/1998 | Gire | 165/167 |

FOREIGN PATENT DOCUMENTS

| | | | |
|---|---|---|---|
| 571706 | 2/1923 | Germany | 165/167 |
| 4128153 | 2/1993 | Germany | 165/167 |
| 289677 | 5/1928 | United Kingdom | 165/167 |
| 533410 | 2/1941 | United Kingdom | 165/167 |
| 2270971 | 3/1994 | United Kingdom . | |

*Primary Examiner*—Ira S. Lazarus
*Assistant Examiner*—Terrell McKinnon
*Attorney, Agent, or Firm*—Evenson, McKeown, Edwards & Lenahan, PLLC

[57] ABSTRACT

Known designs of disk coolers for motor vehicles have flow guides intended to achieve optimum through flow in the hollow chambers formed in the disk coolers. It has been found that the through flow is nevertheless not optimal. Accordingly, it is proposed, at least in the hollow chambers through which the oil flows, to block off the inlet and outlet openings located in the vicinity of a cental return opening respectively by partitions that form flow pockets that serve to force the medium flowing at the periphery of the respective hollow chambers to pass through the entire cross sections of the chambers. This improved construction is suitable for use for disk oil coolers of motor vehicle engines.

9 Claims, 3 Drawing Sheets

DISK COOLER

The invention relates to a disk cooler, especially an oil/coolant cooler for vehicle engines, said cooler consisting of a plurality of tub-shaped disks stacked on top of one another with their edges overlapping, said disks forming hollow chambers, with the adjacent hollow chambers each being traversed by oil or a coolant and provided with inflow and outflow openings provided on opposite sides of a circular sealing collar provided at the center of each disk, said collar forming a through central opening with the sealing collars of the other disks, with a flow guide wall located toward the center being associated with the inflow and outflow openings in each chamber to produce a through flow in the hollow chamber that is as complete as possible.

A disk cooler of this type is known from U.S. Pat. No. 4,708,199. In that patent, the disks are designed so that a collar of the disk located beneath that is approximately semicircular in shape and projects into the hollow chamber located above, but does not penetrate as far as the upper closure of the hollow chamber into the circular inflow and outflow openings of a disk. Since this collar is located toward the center in each case, it serves to reduce the free flow cross section toward the center of the hollow chambers and hence acts as a flow guide wall so that direct flow from the inflow opening to the outflow opening around the center, which would not include the entire hollow chamber, is avoided. In addition, in the hollow chambers in that patent, flow resistances have also been provided in the form of pronounced bumps of different shapes by which the disk surface is also increased so that optimum heat transfer is achieved.

It is also known in disk coolers of the species recited at the outset to insert so-called turbulence sheets into the hollow chambers (GB 2 270 971 A), by which the heat transfer from a disk to another can be improved because of the much greater heat transfer area. In such designs as well, however, as in the designs recited at the outset, in which the flow guide wall does not form a partition, assurance cannot always be provided that the largest possible space within the hollow chamber is traversed by the medium in order to permit optimum heat transfer.

Hence the goal of the present invention is to design a disk cooler of the species recited at the outset such that forced flow through an area in each hollow chamber that is as large as possible, especially in hollow chambers traversed by oil, is achieved.

To achieve this goal, in a disk cooler of the species recited at the outset it is proposed to design the flow guide walls as partitions in the hollow chamber and to cause them to project from the sealing collar forkwise in the shape of two prongs, so that they form a flow pocket that is open only toward the periphery.

As a result of this design, the medium entering the hollow chamber, especially the oil to be cooled, can flow out only outward toward the circumference of the disk and thus flows through the entire area up to the outside edge, and is then deflected in the outer area and so can reach the corresponding outflow opening that is closed off.

In an improvement on the invention, the inflow and outflow openings are both designed as elongate holes in the shape of curved arcs and located in the vicinity of the sealing collar, and arranged concentrically with respect thereto. In such an arrangement, the flow pockets formed according to the invention have an especially advantageous effect because they guarantee flow completely through the hollow chamber.

In an improvement on the invention, the prongs can be made as beads that project from the disk. Advantageously, each bead is pushed out from half way up the partition into the adjoining disk, namely in each case toward the sides that face one another following assembly. These two partial beads abut one another inside the hollow chamber and can be connected tightly in known fashion by soldering the disk cooler together.

In an improvement on the invention it has been shown to be advantageous to make the prongs of the partition associated with the inlet opening extend radially with respect to the sealing collar and then run approximately parallel to one another. As a result an especially good outward flow can be achieved. In an improvement on the invention, on the other hand, the prongs of the outlet opening are made in the shape of an arc, especially a circular arc, and enter the sealing collar by a perpendicular initial area.

Finally, in an improvement on the invention, each of the hollow chambers provided with the partitions can be associated in an especially advantageous fashion with a turbulence insert that is provided with cutouts to match the path of the partitions. As a result, the corrugations of the turbulence insert can advantageously be designed so that they extend toward the inflow opening in the direction of the parallel part of the prongs so that the axes of their through-flow openings, which are located offset with respect to one another, are vertical with respect to this part of the prong. This design offers the advantage that a relatively low resistance prevails in the area where the narrowest flow cross section is located, i.e. between the end of the prong and the edge of the hollow chamber, as a result of the alignment of the corrugations of the turbulence insert, said resistance not preventing through flow from the flow pocket formed by the partition. Therefore this design contributes to ensuring optimum flow through the entire hollow chamber with the turbulence insert in place, so that the efficiency of the heat transfer can also be increased as a result.

The invention is illustrated by an embodiment in the drawing and is explained below.

Figure 1:
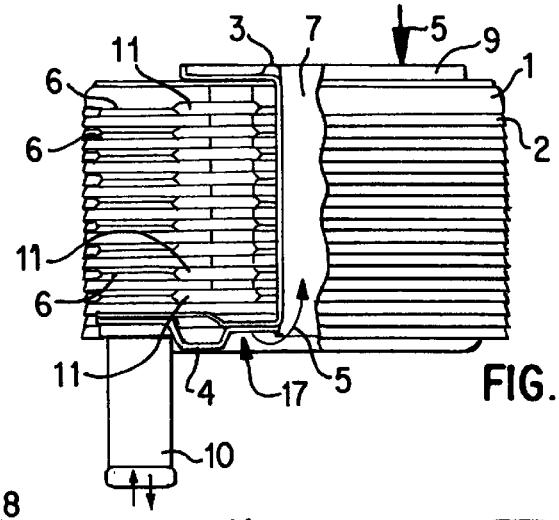
FIG. 1 is a partially cut away side view of a disk cooler according to the invention.
Figure 2:
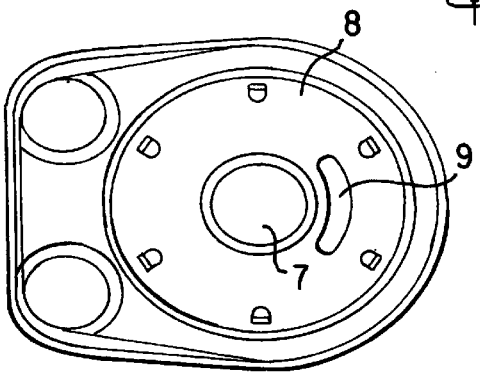
FIG. 2 is a top view of the disk cooler in FIG. 1.
Figure 3:
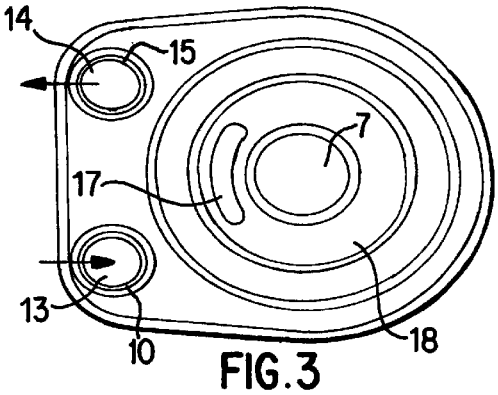
FIG. 3 is a bottom view of the disk cooler according to FIG. 1.
Figure 4:
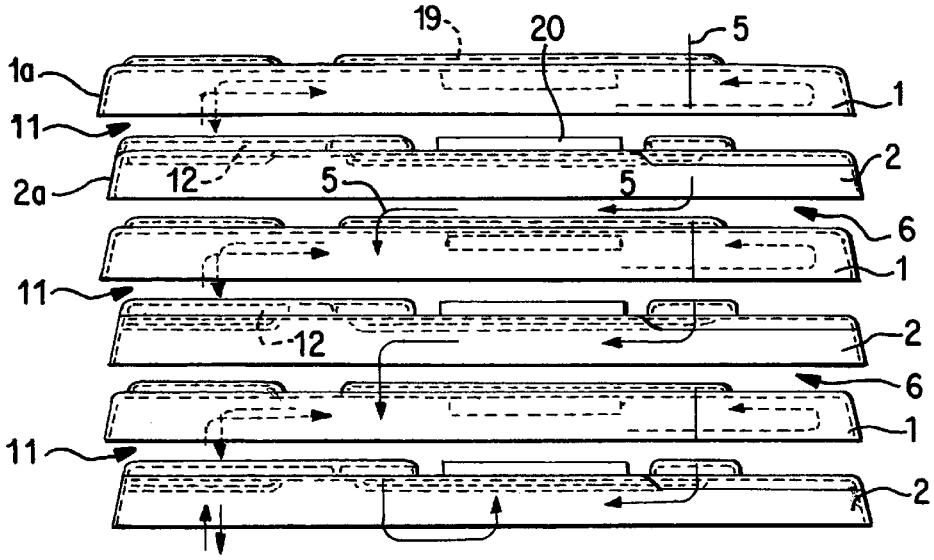
FIG. 4 is a schematic diagram of the design of the disk cooler according to FIG. 1.

FIGS. 1 to 3 show a disk oil cooler for a vehicle engine, which is composed in a manner described in greater detail in FIG. 4 of a plurality of tub-shaped disks 1 and 2 of the same design stacked on top of one another. The stack thus formed from the two disk types 1 and 2 is sealed off at top and bottom by cover plates 3 and 4 respectively, so that when edges 1*a* and 2*a* of the disks are stacked on top of one another, each overlaps the edge of the adjacent disk and thus a tight housing results after soldering.

As is also explained in greater detail below with reference to FIGS. 5 and 6 and 9 and 10, disks 1 and 2 are designed in a special fashion so that the oil to be cooled enters the disk stack in the direction of arrows 5, shown extended. In the hollow chambers in which a disk 2 is located at the top and forms a hollow chamber 6 together with the disk 1 located beneath to allow oil to flow through, the oil flows through this hollow chamber 6 in the direction of arrows 5 and is then deflected ahead of lower end plate 4 into a central through opening 7 and is guided upward once again from there.

As a rule, the disk stack is then mounted tightly directly on the engine block together with upper cover plate 3 so that oil can enter from the motor in the direction of arrow 5 into annular chamber 8 shown in FIG. 2 and into uppermost inflow opening 9 in the direction of arrow 5, while the incoming and cooled oil is returned to the motor through central opening 7.

The coolant, preferably the engine coolant, with the engine not shown, enters the disk stack through inlet stub 10, distributes itself inside the disk stack among hollow chambers 11, each of which is formed by a disk 1 on top and a disk 2 beneath, and then flows roughly in the shape of an arc inside the corresponding hollow chamber 11, because of a partition 12 provided between inflow openings 13 and outflow openings 14 in each of chambers 11, in the direction of arrows 16 represented by dashes, and leaves the chamber through outflow opening 14 and then outflow stub 15 shown in FIG. 3, said stub being located behind the inflow stub in FIG. 1. Since hollow chambers 6 and 11 adjoin one another, see FIG. 1, and are arranged alternately, excellent heat exchange in a limited space is made possible in this manner.

FIG. 3 shows lowermost outlet opening 17 of the disk stack which, when a suitable lower cover disk 4 is provided, allows the cooled oil to flow through annular chamber 18 back into central bore 7. However, it is also possible if desired to provide a filter at this point through which the cooled oil coming from outflow opening 17 flows and only then enters a central opening of the filter, not shown, which is flush with central opening 7 of the disk cooler.

Figure 5:
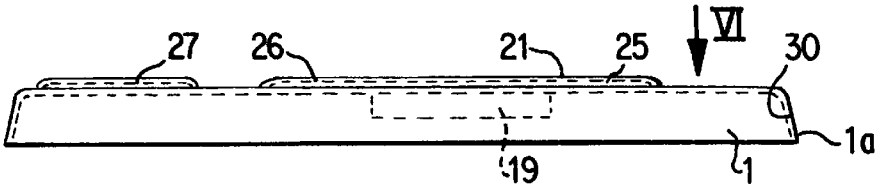
FIG. 5 is one of the disk designs shown in FIG. 4 for assembling the disk cooler according to FIG. 1, in a side view resembling FIG. 4.
Figure 6:
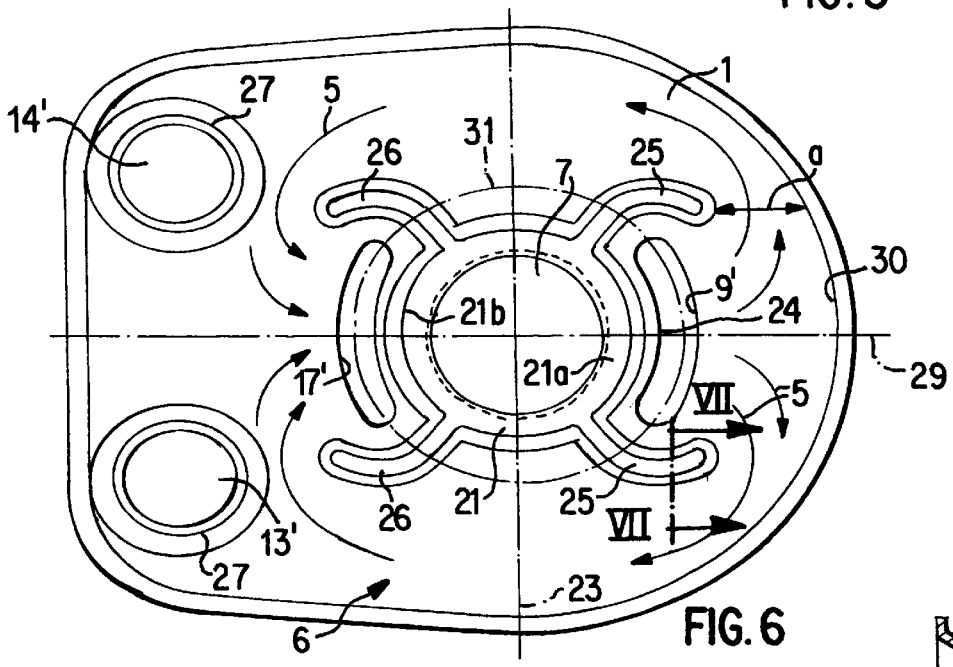
FIG. 6 is a top view of the disk in FIG. 5.

FIGS. 5 and 6 show that each of disks 1 is firstly provided with a sealing collar 19 that projects into its tub-like shell area and is disposed approximately centrally, said collar together with a collar 20 of adjoining disk 2 (see FIG. 4) providing the seal required between through opening 7 and hollow chamber 6. Sealing collar 19 (and collar 20) thus project into hollow chamber 11 traversed by coolant during operation.

Disk 1 however also has upwardly pressed elevations, firstly a surface 21 forming an annular wall, said surface later producing the seal for central opening 7 in hollow chamber 6 which disks 1 and 2 are fitted together with the corresponding annular surface 22 of disk 2 (see FIG. 10, where ring 22 in disk 2 is pushed out downward toward hollow chamber 6). Of course annular wall surface 21 pressed out upward out of disk 1, has a height such that it reaches the height of hollow chamber 6 together with downwardly projecting annular surface 22 of disk 2 when the stack is assembled and therefore can form the desired seal with respect to opening 7. Disk 1 has an inflow opening 9' made in the shape of an elongate hole, with the shape of said opening matching that of opening 9 shown in FIG. 2 and being provided with a prime only to distinguish it from the latter. Opening 9' is located concentrically with respect to the axis of opening 7 and thus is also concentric with respect to annular wall 21. Outflow opening 17' is located opposite, with the shape of said opening in turn corresponding to the shape of outflow opening 17 shown in FIG. 3, and provided with a prime only to distinguish it from the latter. Openings 9' and 17' are the same size and are located with mirror symmetry with respect to plane 23 that passes through axis 24 of opening 7 and runs parallel to the axes of inflow and outflow stubs 10 and 15 respectively. In order to ensure an oil flow that fills all of the areas of chamber 6 if possible in chambers 6 through which the oil flows, prongs 25 and 26 project forkwise from annular wall 21, said prongs being formed as beads pushed out of the sheet metal of the disk, said beads having the height of annular wall 21. Since disk 1, like disk 2, consists in a manner known of itself of a thin aluminum sheet, this shaping process is easy to perform. In addition, in the vicinity of connecting stubs 10 and 15, openings 13' and 14' are also embossed in disk 1, but they are also surrounded by an annular elevation 27 that likewise has half the height of hollow chamber 6 formed later. This annular wall 27, together with annular wall 28 that likewise projects into chamber 6, later seals hollow chamber 5 off from the coolant supply.

The two prongs 25 that project forkwise from annular wall 21 have portions that start at annular wall 21, run approximately radially with respect to wall 21, and then change into two end sections that run parallel to one another. The two prongs 25, like prongs 26, are also arranged with mirror symmetry relative to a plane 29 that runs through axis 24 of opening 7 and is perpendicular to plane 23. Prongs 25 terminate, each measured parallel to plane 29, at a distance a in front of wall 2*a* that forms outside wall (1*a*, 2*a*) and/or periphery 30 of hollow chamber 6, of disk 2 not shown in FIGS. 5 and 6 but located above, whose wall is connected with wall 1*a* of disk 1 which forms wall 30 and closes off chamber 11.

Prongs 26 differ in shape from prongs 25. They are also mounted with mirror symmetry relative to plane 29 but they fit around the ends of opening 17' in the shape of an arc. They are however made in the shape of a circular arc that extends from circle 31 that passes in a straight line through the middles of openings 17' and 9' and runs perpendicularly into annular wall 21.

Figure 8:
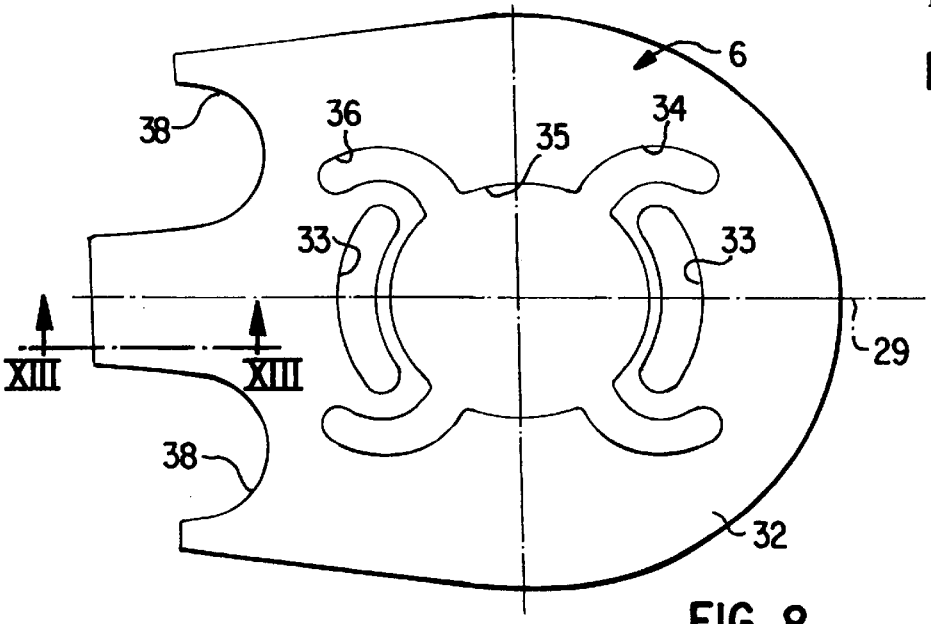
FIG. 8 is a top view of a turbulence insert placed on top of the disk in FIG. 6.

A turbulence insert 32 as shown in FIG. 8 is inserted into each of hollow chambers 6, the height b of said insert (see FIG. 13) corresponding in known fashion to the height of hollow chamber 6 and adapted shapewise to both hollow chamber 6 and the projections embossed in disk 1. Therefore it is evident that turbulence insert 32 with recess 33 in the form of openings 9' and 17' is provided with both a recess 35 with the size of the outer circumference of annular wall 21 as well as arm-shaped recesses 34 and 36 that begin at this recess 35, said recesses matching the shapes of prongs 25 and 26. Turbulence insert 32 is also provided with two recesses 37 and 38 open to the exterior, said recesses being adapted to the circumference of annular walls 27. Therefore, during the assembly of the disk cooler, turbulence insert 32 can rest against disk 1, which is then in turn covered by disk 2.

Figure 9:
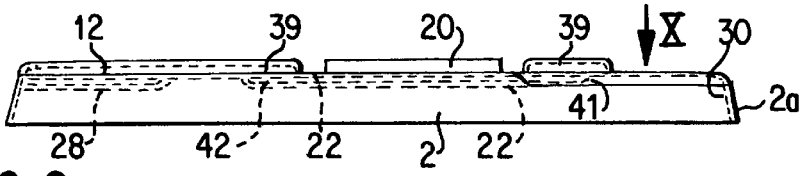
FIG. 9 is a side view of a disk of the second type used to construct the disk cooler according to FIG. 4.
Figure 10:
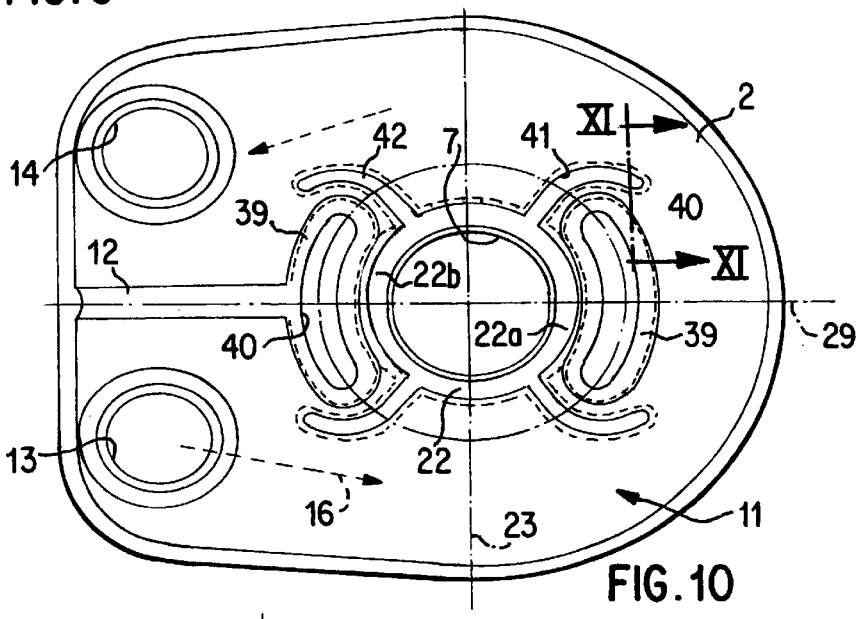
FIG. 10 is a top view of the disk in FIG. 9.
Figure 13:
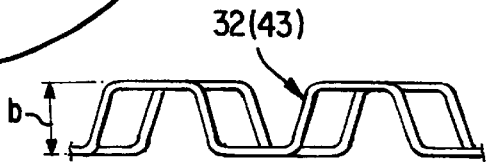
FIG. 13 is a section through the turbulence inserts in FIGS. 12 and 8, along section line XIII in each case.

FIGS. 9 and 10 show that tub-shaped disk 2 is provided with first elevations 39 projecting upward, said elevations being provided with openings 40 that match the shapes of openings 9' and 17'. These elevations 39 have the height of chamber 11 through which the coolant flows. They are supplemented by partition 12, already mentioned above, between the two openings 13 and 14, said partition running in plane 29 mentioned above and being as high as elevations 39. Partition 12 therefore cuts off the section of chamber 11 that communicates with inlet opening 13 from the section that communicates with outflow opening 14, so that the coolant, as mentioned above, must flow in the shape of an arc in the direction of dotted arrows 16 in hollow chamber 11. As can also be seen from FIGS. 9 and 10, however, disk 2 also has bead-shaped embossed areas in the shape of an annular wall 22, said areas however being directed toward the side opposite the embossing direction of elevations 39. This annular wall 32 also makes a transition to beads 41, 42, said beads being located symmetrically to plane 29 and having a shape that matches beads 25 and 26. In t he manner described above, they supplement beads 25 with respect to the partitions located toward the center in hollow chamber 6 that surround openings 9' and 17'. These partitions formed by prongs 25, 41 and 26, 42 and by sections 21*a* and 21*b* and 22*a* and 22*b* of annular walls 21 and 22 located between the prongs therefore constitute flow pockets within hollow chambers 6, from which pockets the oil flow in the direction of arrows 5 shown in FIG. 6 is forced to flow throughout the entire area of hollow chambers 6, with the oil having no opportunity to flow the shorter distance from opening 9' to opening 17' along annular wall 21. Since turbulence insert 32 is also located in hollow chamber 6 whose corrugations match the pattern of section XIII in FIG. 8 and parallel to plane 29 as shown in FIG. 13, a largely open flow cross section of the turbulence sheet is available in the vicinity of space a between the ends of the prong-shaped partitions and edge 30 that offers much higher flow resistance in the direction parallel to plane 29, i.e. in the wider flow cross section inside hollow chamber 6. Also as a result of this alignment of the corrugations of turbulence insert 32, the flow is favored in such fashion that it proceeds as uniformly as possible through the entire space of the hollow chamber. Of course this also takes place in the flow cross section between annular wall 27 and the ends of prongs 26.

Figure 12:
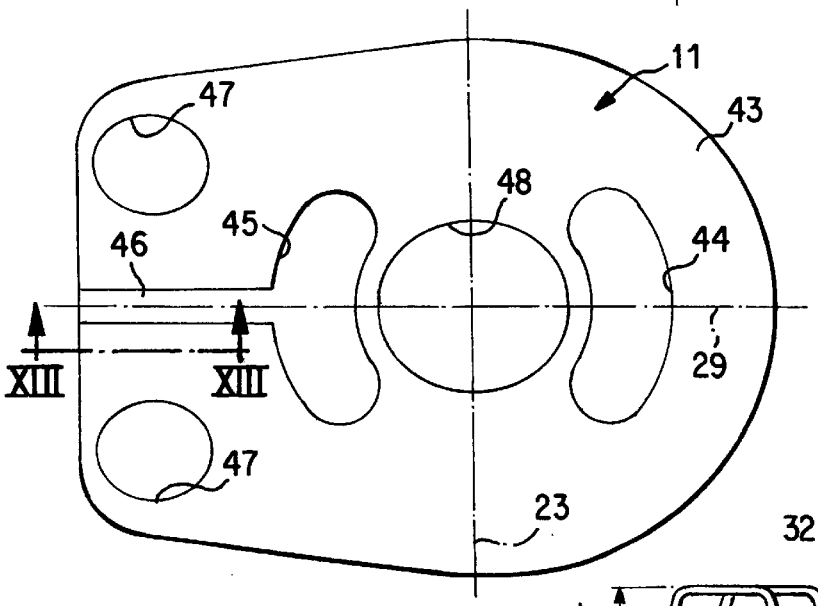
FIG. 12 is a top view of a turbulence insert placed on the disk according to FIG. 10.

FIG. 12 shows a turbulence sheet 43 inserted into hollow chamber 11 in the area above each of disks 2. Turbulence sheet 43 has two recesses 44 and 45 for this purpose that are adapted to the circumference of elevations 39. A slot 46 runs outward from elevation 45 in which partition 12 can be accepted. A central opening 48, located at the intersection of previously described planes 23 and 29 and having a circular shape, is adapted to the inside diameter of through opening 7 in disk 2. Two additional circular openings 47 have dimensions that match those of through openings 13 and 14 of disks 2. Here again the alignment of the corrugations is the same as in turbulence insert 32, as clearly shown by section XIII and the view in FIG. 13.

Figure 7:
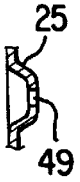
FIG. 7 is a partial section along VII in FIG. 6 in an enlarged view.
Figure 11:
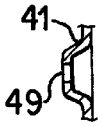
FIG. 11 is a partial section through the disk in FIG. 10 along section line XI in an enlarged state.

It should also be pointed out that beads 25 and 41, shown enlarged in FIGS. 7 and 11, abut one another with their surfaces when the two disks 1 and 2 are assembled, and therefore can be tightly soldered to one another at their areas 49, like the other parts of disks 1 and 2. In this manner, the through partition is obtained in hollow chamber 6 to form the flow pocket.

I claim:

1. Disk cooler, especially an oil/coolant cooler for vehicle engines, comprising:

a plurality of tub-shaped disks stacked within one another with their edges overlapping and defining adjacent chambers, certain chambers being traversed by oil and other chambers being traversed by coolant, each chamber of one set of said chambers being provided with inlet and outlet openings, a circular annular wall located in the center of each disk, the inlet and outlet openings of each of said one set of chambers provided on opposite sides of the circular annular wall, each circular annular wall, together with the circular annular walls of the other disks, forming a central through opening, and a flow guide wall located toward said central through opening to optimize the flow between the inlet and outlet openings of each of said one set of chambers, wherein the flow guide wall is designed as a partition in each of said one set of chambers, said partition projecting forkwise, in the form of multiple prongs, from the circular annular walls in each of said one set of chambers and forming a flow pocket open only toward a periphery of each of said one set of chambers.

2. Disk cooler according to claim 1, characterized in that inlet and outlet openings (9', 17') in hollow chamber (6) are made in the form of elongate holes in the shape of circular arcs, located in the vicinity of annular walls (21, 22).

3. Disk cooler according to claim 2, characterized in that elongate holes (9', 17') are located concentrically relative to axis (24) of through central opening (7).

4. Disk cooler according to one of claims 1 to 3, characterized in that prongs (25, 41, and 26, 42) are formed by beads embossed in disks (1, 2).

5. Disk cooler according to claim 4, characterized in that beads (25 and 26 and 41, 42) with half the height of the hollow chamber are provided in adjoining disks (1, 2), said beads being connected tightly together at their abutting surfaces (49).

6. Disk cooler according to claim 4, characterized in that prongs (25, 41) of inlet opening (9') initially extend radially away from annular wall (21, 22) and then make a transition to sections that are approximately parallel to one another.

7. Disk cooler according to claim 4, characterized in that prongs (26, 42) of outflow opening (17') are made in the form of arcs, especially circular arcs, and enter annular wall (21, 22) perpendicularly by a straight section.

8. Disk cooler according to claim 1, characterized in that a turbulence insert (32) is provided in each of hollow chambers (6) provided with partitions (25, 41, 22*a* and 26, 42, 22*b*), said insert being provided with recesses (34, 35, 36) that match the pattern of partitions (25, 41 and 26, 42).

9. Disk cooler according to claim 8, characterized in that the corrugations of turbulence insert (32) extend in the direction of the parallel portions of prongs (25, 41).

* * * * *